US006171201B1

(12) United States Patent
Tiller

(10) Patent No.: US 6,171,201 B1
(45) Date of Patent: Jan. 9, 2001

(54) GOLF SWING ALIGNMENT APPARATUS

(76) Inventor: Kenneth R. Tiller, 410-520 Dunedin Street, Victoria, B.C. (CA), V8T 2L6

( * ) Notice: Under 35 U.S.C. 154(b), the term of this patent shall be extended for 0 days.

(21) Appl. No.: 09/374,124

(22) Filed: Aug. 12, 1999

(51) Int. Cl.[7] ..... A63B 69/36
(52) U.S. Cl. ..... 473/278; 473/270; 473/266
(58) Field of Search ..... 473/278, 218, 473/266, 270, 150; 434/252

(56) References Cited

U.S. PATENT DOCUMENTS

| | | | |
|---|---|---|---|
| 3,550,946 | 12/1970 | Menendez . | |
| 3,580,584 | 5/1971 | Trosko . | |
| 3,868,109 | 2/1975 | Fowler . | |
| 3,920,248 * | 11/1975 | Medders | 473/270 |
| 4,101,130 | 7/1978 | Richards . | |
| 4,478,422 | 10/1984 | Blanchard . | |
| 4,538,815 | 9/1985 | Poirier . | |
| 4,805,913 | 2/1989 | Bott . | |
| 5,042,815 | 8/1991 | Sutton . | |
| 5,333,875 | 8/1994 | Wilson . | |
| 5,415,407 | 5/1995 | Beatty . | |
| 5,437,448 | 8/1995 | Balson . | |
| 5,645,494 | 7/1997 | Dionne et al. . | |
| 5,984,801 * | 11/1999 | Mason | 473/270 |

* cited by examiner

*Primary Examiner*—Kien T. Nguyen
(74) *Attorney, Agent, or Firm*—Robert H. Barrigar

(57) ABSTRACT

An apparatus for temporary use with a golf driving range mat or ground practice area in teaching the proper stance for a golfer when swinging a golf club to hit a golf ball placed upon a tee inserted into the mat or the ground. The apparatus comprises first and second strips of flat elastic material. Each strip has a length selected so that the strip will be under moderate tension when it is stretched across the mat from one edge of the mat to the opposite edge of the mat and held against the mat by a discrete anchor at each end of the strip. The strips may be stretched across the mat so that the first strip is aligned in parallel with the intended direction that the golf ball is to be hit at a distance from the golf ball selected to be appropriate for the golfer and the second strip is perpendicular to the first strip and passes alongside the tee so that the head of the golf club will pass over the second strip after hitting the golf ball, thereby providing reference lines for placement of the golfer's feet.

9 Claims, 3 Drawing Sheets

GOLF SWING ALIGNMENT APPARATUS

FIELD OF THE INVENTION

This invention relates primarily to apparatus for assisting golfers with alignment and ball position to improve their golf swings. More particularly, the invention concerns a golf swing alignment apparatus for use with driving range golf practice mats typically provided at driving ranges as well for use at driving ranges that provide a ground surface only.

BACKGROUND OF THE INVENTION

At a driving range, a golfer wishing to practice his golf swing places a golf ball on a tee inserted into the tee hole in, or upon the surface of, a golf mat practice mat and attempts to place his feet in an appropriate position on the mat so as to properly align himself to swing a golf club to drive the golf ball in a desired direction. If we consider one reference line passing in just in front of the toes of the golfer's feet and another reference line perpendicular to the first line passing through the ball, then the appropriate position for the golfer's feet is determined by the distance of the first reference line from the ball as well as position of the intersection of the two reference lines relative to the golfer's feet.

While reference lines could be incorporated into the surface of the mat to aid in the placement of the golfer's feet, mats incorporating reference lines are not normally found at driving ranges, perhaps because mats are typically rotated periodically to even out wear, necessitating a large number of sets of reference lines. Further, several lines would be needed in each set to accommodate golfers of varying size and the configuration of the reference lines would vary with the type of golf club used, even for the same golfer. For example, a mat incorporating such reference lines is disclosed in Dionne et al., U.S. Pat. No. 5,645,494.

A number of other golf practice mats are known for aligning a golfer's swing. For example, Fowler, U.S. Pat. No. 3,868,109, Richards, U.S. Pat. No. 4,101,130, Menendez, U.S. Pat. No. 3,550,946, and Bott, U.S. Pat. No. 4,805,913 disclose such mats. In each case, the golfer wishing to use such mats at a driving range must rely upon the operator of the driving range to provide such mats or must transport his own mat to the driving range, at best an inconvenience.

Other golf swing alignment aids are known. For example, Trosko, U.S. Pat. No. 3,580,584, Medders, U.S. Pat. No. 3,920,248, Blanchard, U.S. Pat. No. 4,478,422, Poirier, U.S. Pat. No. 4,539,815, Beatty, U.S. Pat. No. 5,415,407, and Balson, U.S. Pat. No. 5,437,448, disclose various templates, frames, or arrangements of cords or strips.

Of the alignment aids mentioned, only Beatty, U.S. Pat. No. 5,415,407, in FIG. 5 thereof discloses an apparatus suitable for use with a golf mat 30. However, it appears that the mat 30 must have specific characteristics, such as an aperture 37 near the tee 38 and an over-all square shape, which may not be present in golf mats found at all driving ranges (most golf mats in use are now octagonal). Further, strips 40 do not appear to be repositionable for golfers of varying size and for the use of a variety of golf clubs and are held in place by springs 39 and J-hooks 36, both of which protrude somewhat above the surface of the mat 30 and so may interfere with the golfer's swing.

Sutton, U.S. Pat. No. 5,042,815, discloses a golf swing alignment device including a mat 28 and several flexible cords 22, which act as reference lines, and frames 26 for holding the cords 22 in place. The cords 22 and frames 26 appear to be selected for the mat 28 of a particular size as the cords 22 are not specifically elastic. Further, the frames 26 appear to protrude above the surface of the mat 28, possibly leading to interference with the golfer's swing. As well, if the golf ball is accidentally hit along the surface ("topping the ball"), then the ball could be deflected by the frames 26 cause injury to bystanders.

To the knowledge of the inventor, a compact, easily transportable, and inexpensive golf swing alignment apparatus for use at driving ranges with or without the golf mats that happen to be present has not been available previously.

SUMMARY OF THE INVENTION

The present invention is directed in one aspect to providing a removable and repositionable apparatus that can be easily installed on a golf driving range mat so as to provide swing alignment assistance to a golfer who wishes to improve his or her ball striking abilities through a more complete understanding of the critical elements of body alignment, stance and ball positioning. In addition, for safety reasons, the apparatus sits flush with or below the surface of the golf practice mat reducing the possibility of contact between the golf ball or golf club and any part of the apparatus that could deflect the golf club or golf ball and cause injury or damage.

In effect, the apparatus provides two reference lines, one line parallel to the desired direction of flight and the other passing through or next to the tee (or the position of the golf ball if no tee is being used) and perpendicular to the direction of flight. The apparatus comprises first and second strips of flat elastic material and four anchors. Each strip has a length selected so that the strip will be under moderate tension when it is stretched straight across the mat from one edge of the mat to the opposite edge of the mat and held against the mat by a discrete anchor at each end of the strip. In use, the strips are stretched across the mat so that the first strip is aligned in parallel with the intended direction that the golf ball is to be hit at an adjustable distance from the golf ball selected to be appropriate for the golfer. The second strip is aligned perpendicular to the first strip alongside the tee (or the position of the golf ball if no tee is being used) so that when the golfer swings the head of the golf club will pass over the second strip after hitting the golf ball. Alternatively, the golfer may use only one strip at a time as the strips are independent of each other.

Each strip has at least one discrete eyelet at each end thereof. Each anchor has two portions, a flat rigid first portion for placement under the mat near an edge of the mat and a second portion extending generally upward beside that edge of the mat when the first portion is so placed. The second portion ends in a hook that may be passed through a discrete eyelet of a strip to anchor in place the end of the strip having that eyelet. Once a discrete anchor is attached to each end of a strip, the hook of each anchor is bent over so that the anchors will stay attached to the ends of the strip. The upward extension of the second portion of the anchor when in place is less than the thickness of the mat so that the eyelets of the strips are held below the upper surface of the mat when the strips are anchored in place, thereby to reduce the possibility of interference of the apparatus with the golfer's swing and with the flight of the golf ball should the golfer accidentally top the ball. As compared to previously known golf swing alignment aids such as those described in Beatty, U.S. Pat. No. 5,415,407 and Sutton, U.S. Pat. No. 5,042,815 in which springs or frame protrude above the surface, the present invention may offer enhanced safety to bystanders.

Optionally, a third strip may be provided for more advanced golfers who are concerned with the plane in which they swing. The third strip may be positioned on top of the second strip so that the head of the golf club will not hit the second strip or catch on it when the golf ball is hit off the third strip. The third strip is useful for those golfers who wish to hit the golf ball right off the surface without the use of a tee. For example, a beginning golfer while practicing putting or an advanced golfer practicing with all clubs except drivers may wish to use the apparatus without a tee.

DETAILED DESCRIPTION OF THE PREFERRED EMBODIMENT

Figure 1:
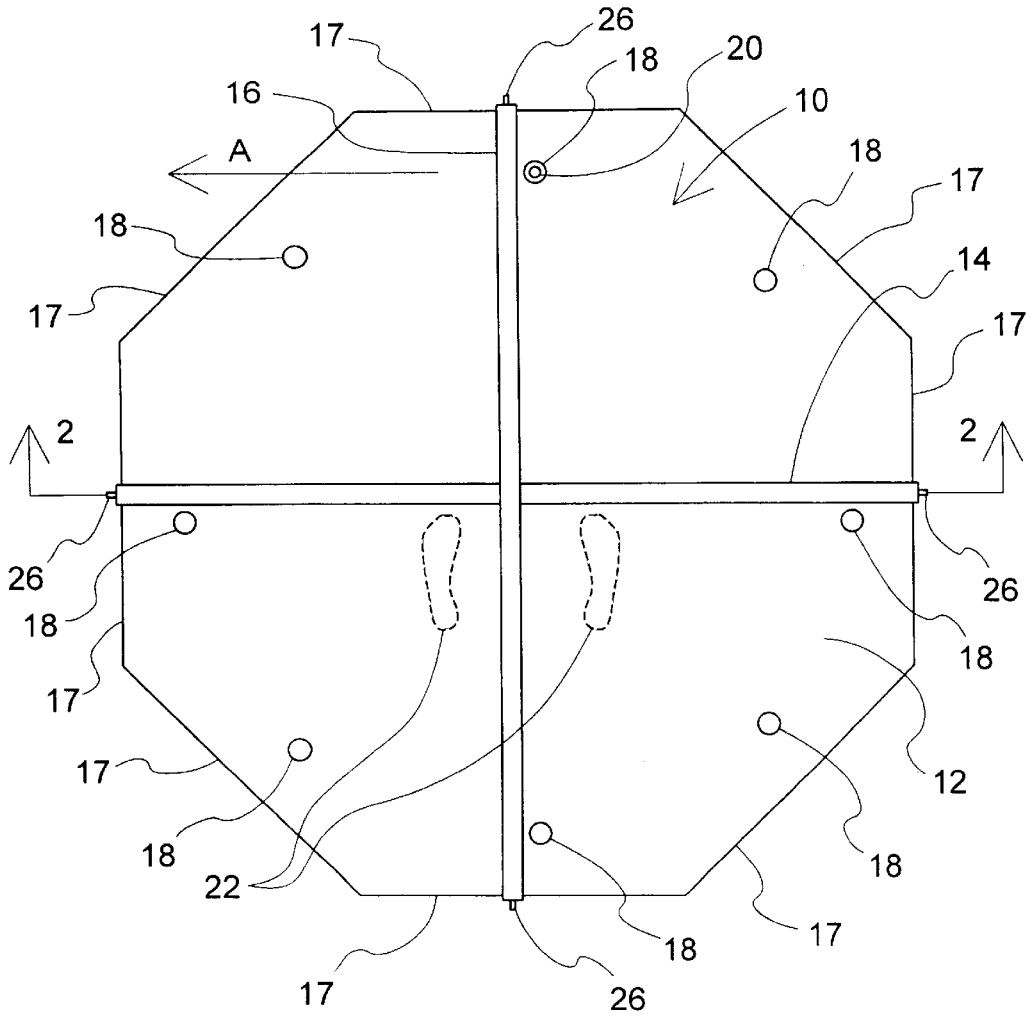
FIG. 1 is an overall schematic plan view of an embodiment of a golf swing alignment apparatus in accordance with the invention installed upon a golf driving range practice mat.
Figure 2:
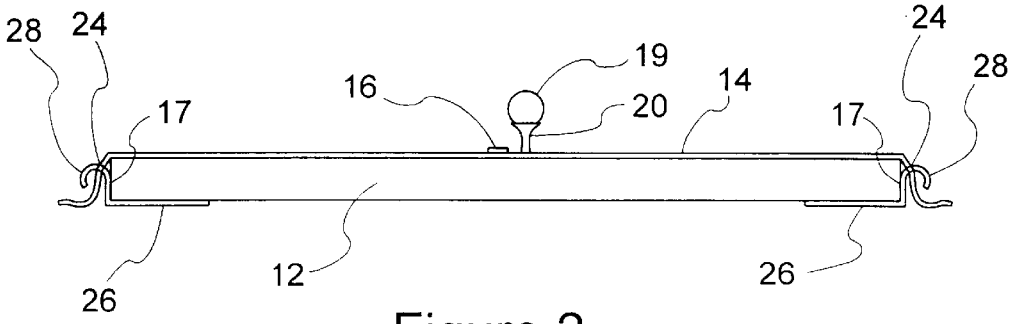
FIG. 2 is a schematic cross-sectional elevation view taken along line 2—2 of the golf swing alignment apparatus of FIG. 1 installed upon a golf driving range practice mat.

The golf swing alignment apparatus, generally indicated by reference numeral 10, is shown in FIGS. 1 and 2 installed upon an octagonal golf driving range practice mat 12. Such mats are widely used at golf driving ranges and are typically 60" across and 1" or slightly more in thickness.

The exemplary golf practice mat 12 has several tee holes 18 each located approximately 5" from an edge 17 on a line passing through the center of the mat 12. An octagonal mat, such as that shown in FIGS. 1 and 2, typically has at least eight tee holes 18 so that the mat 12 can be rotated to even out wear. Some mats have more than one tee hole 18 along each edge 17 to accommodate both right and left handed golfers. Such additional tee holes are not shown in the drawings, however, the apparatus 10 may be used with mats having such additional tee holes without modification.

As commonly used at driving ranges, a golfer places a golf ball 19 on a tee 20 inserted into the tee hole 18 and attempts to place his feet, for example as shown in dashed lines as reference numeral 22 in FIG. 1, in an appropriate position on the mat 12 so as to properly align himself to swing a golf club to drive the golf ball in a desired direction, for example as indicated in FIG. 1 by arrow A. Proper placement of the feet is a matter of experience as there are normally no reference lines on the mat 12. A beginning golfer will generally use a tee 20 for all practice shots off the mat 12, but an experienced golfer may use a tee 20 only for drivers. Hence in the following discussion it should be understood that the use of a tee 20 is optional; the ball may simply be placed on an easily recognizable spot on that mat 12 for each shot.

Figure 4:
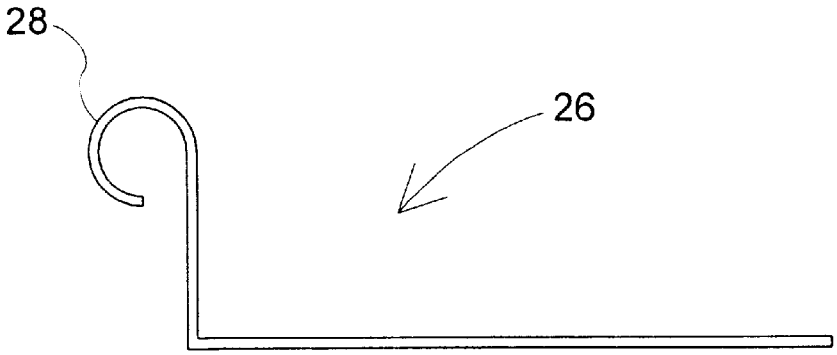
FIG. 4 is a schematic side elevation view of one of the anchors of the golf swing alignment apparatus of FIG. 1.
Figure 5:
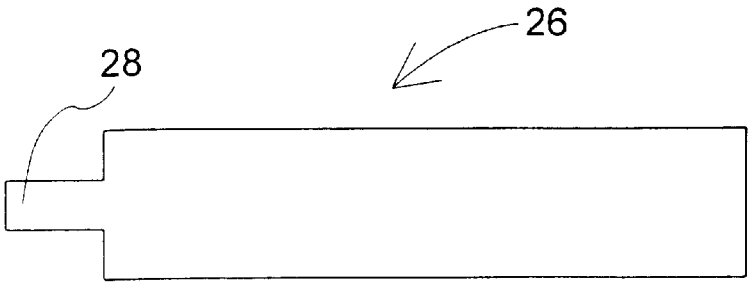
FIG. 5 is a schematic plan view of one of the anchors of the golf swing alignment apparatus of FIG. 4.

To provide two reference lines for the golfer, one line parallel to the desired direction of flight and the other passing through the location of the golf ball and perpendicular to the direction of flight, two flat strips of elastic material 14, 16 are provided, each of the strips 14, 16 having at least one discrete eyelet 24 near each end. Four anchors 26 are also provided for securing the ends of the strips 14, 16 to the edges of the mat 12. The anchors 26 are shown in FIG. 4 in elevation view and FIG. 5 in plan view. Each anchor 26 has a curled end or hook 28. The opening in each eyelets 24 is sufficiently large to pass a hook 28 therethrough in the manner illustrated in FIG. 2.

Figure 3:
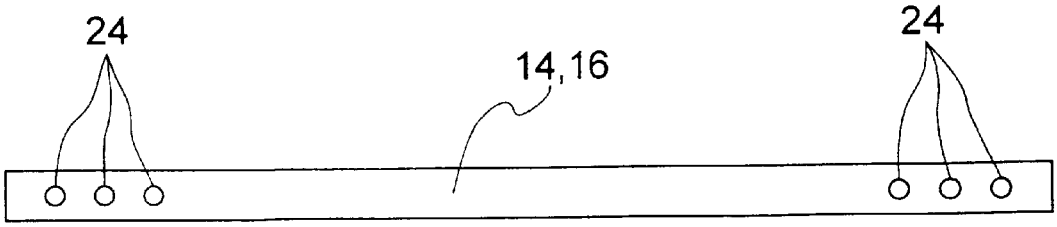
FIG. 3 is a schematic plan view of one of the elastic strips of the golf swing alignment apparatus of FIG. 1.

A plan view of an exemplary one of the strips 14, 16 is shown in FIG. 3. In FIG. 3, three eyelets 24 are shown near each end of the strip 14, 16, but only one eyelet 24 is necessary at each end of the strip 14, 16 if the apparatus is intended only for a standard size mat, although as discussed below at least one additional eyelet 24 may be useful at each end of the strip 14, 16 for anchoring the strip 14, 16 to the ground if no practice mat 12 is available. The length of each strip 14, 16 is selected so that each strip 14, 16 will be under moderate tension when it is stretched across the mat 12 from one edge 17 of the mat 12 to the opposite edge 17 of the mat 12 and held against the mat 12 by a discrete anchor 26 at each end of the strip 14, 16. The apparatus 10 is to be used with a variety of mats of differing size, then the length of each strip 14, 16 is selected to be long enough to accommodate the largest mat size.

The apparatus 10 is prepared for installation on a golf practice mat 12 by first inserting the curled end 28 of a discrete anchor 26 through an eyelet 24 at each end of each strip 14, 16, the eyelets 24 selected so that the strip 14, 16 will be under moderate tension when both of its ends are anchored to the mat 12. Once assembled in this fashion the curled ends 28 may be bent so that the anchors 24 will not become detached from the ends of the strips 14 during normal use and may be left attached when the apparatus 10 is not in use. If it is necessary to move an anchor 24 to a different eyelet 24 because the apparatus 10 is to be used with a different size mat or it is necessary to replace a broken anchor 24, then the curled end 28 of the anchor 24 may be bent back and the anchor 24 removed and another installed. Strip 14 is then stretched across the mat 12 parallel to the desired direction of flight of the golf ball 19 at a distance from the golf ball selected to be appropriate for the golfer and the anchors 26 at each end of the parallel strip 14 slid under opposed edges of the mat 12. Similarly, strip 16 is assembled and stretched across the mat 12 perpendicular to strip 14 so that it passes alongside of the tee 20 so that the head of the golf club will pass over the perpendicular strip 16 after hitting the golf ball 19. If no tee 20 is to be used for a particular shot, then the strip 16 is placed so that the golf ball 19 will be placed beside the strip 16 so that the head of the golf club will hit the ball 19 and then pass over the strip 16, minimizing the likelihood of the head of the golf club catching the strip 16, a possibility that is unlikely as the. strip 16 is essentially flush with the surface of the mat 12.

Once the golf swing alignment apparatus 10 has been installed, the golfer faces the tee 20 and places his toes next to the parallel strip 14 and then uses perpendicular strip 16 as a reference to locate his feet in appropriate positions along parallel strip 14. For example, for some clubs the golfer's feet should be equal distances from the perpendicular strip 16, whereas for other clubs one foot should be closer to perpendicular strip 16 than the other foot (as illustrated in FIG. 1). Parallel strip 14 provides the reference line parallel to the direction of flight of the golf ball and perpendicular strip 16 provides the reference line perpendicular to the direction of flight of the golf ball.

Figure 6:
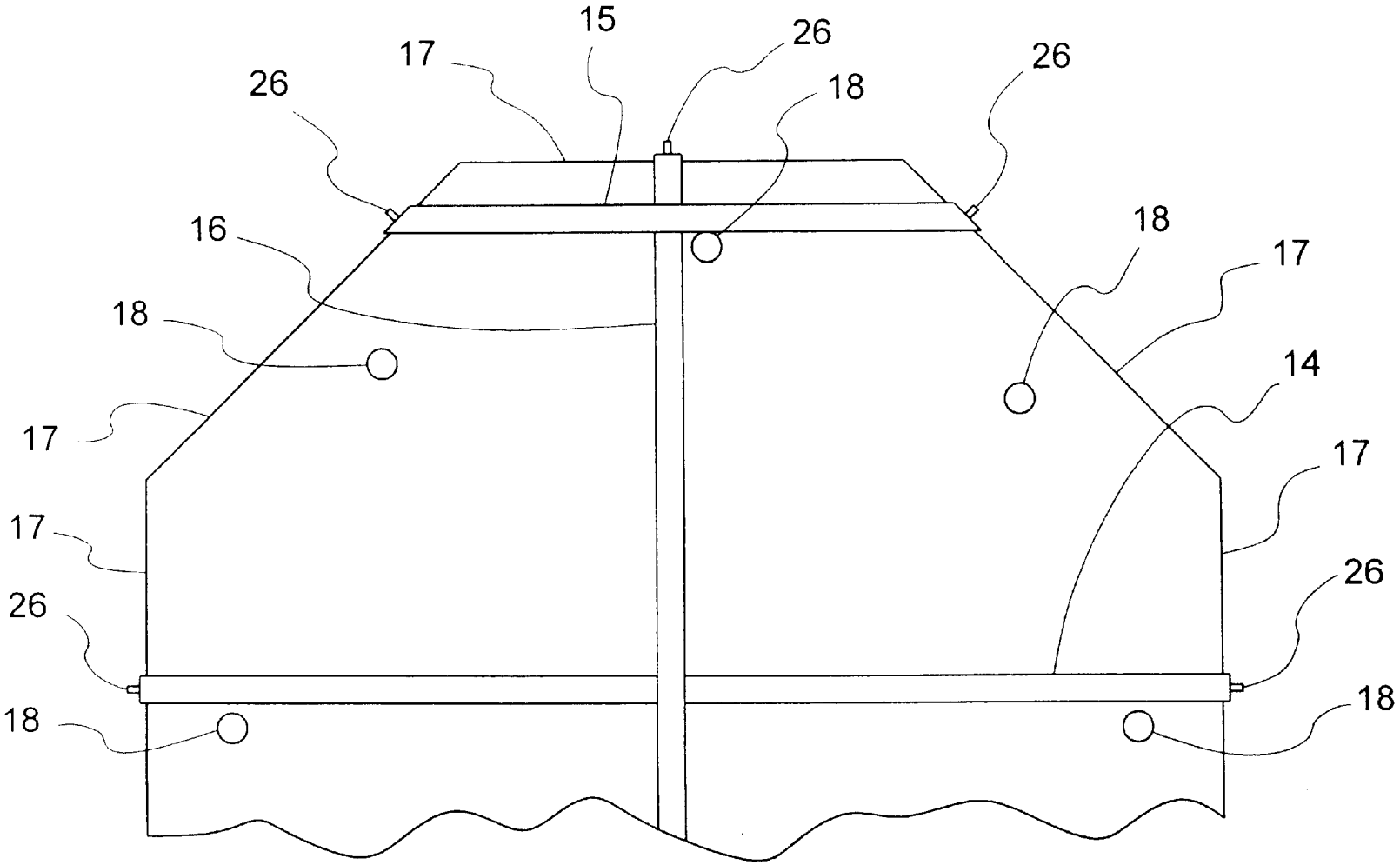
FIG. 6 is a schematic plan view of a portion of the golf swing alignment apparatus of FIG. 1 including an optional third alignment strip.

Optionally, the golf swing alignment apparatus 10 may include a shorter third strip 15, which may be installed as illustrated in FIG. 6 in the same manner as the longer strips 14, 16, using the same type of anchor 26. A length of 32" and width of 1.5" for the third strip 15 is appropriate for a typical golf practice mat. The third strip 15 may also be used without a tee 20 by stretching the strip 15 over the tee hole 18 and placing the golf ball 19 directly on top of the third strip 15. Whether or not a tee 20 is used it is preferable to run the third strip over the top of the second strip 16 so that the head of the golf club will not hit the second strip 16 or catch on it when the golf ball 19 is hit. The third strip 15 may be used by advanced golfers for dealing with swing plane alignment concerns or for putting practice.

Because the apparatus 10 is comprised of flexible elastic strips 14, 16 and relatively small anchors 26, the strips 14, 16 may be rolled up and stored in a compact pouch less than 4" by 7" and transported in the golfer's pocket. The strips 14, 16 may be marked to facilitate positioning on the mat 12 and may display the trademark of the manufacturer or other advertising.

The golf swing alignment apparatus 10 may also be used on the grass by forcing the anchors into the ground at the desired locations or using tees pushed through the extra eyelets.

Other embodiments will be apparent to those skilled in the art and, therefore, the invention is defined in the claims.

What is claimed is:

1. An apparatus for temporary use with a golf driving range mat in teaching the proper stance for a golfer when swinging a golf club to hit a golf ball placed upon the mat or upon a tee inserted into a tee hole in the mat, the apparatus comprising, in combination:

a) a first strip of flat elastic material; and b) two anchors;

the first strip having a length selected so that the strip will be under moderate tension when it is stretched across the mat from one edge of the mat to the opposite edge of the mat and held against the mat by a discrete one of the anchors at each end of the strip, whereby the first strip may be stretched across the mat so that the first strip is aligned in parallel with the intended direction that the golf ball is to be hit and at a distance from the golf ball selected to be appropriate for the golfer, thereby providing a reference line for placement of the golfer's feet;

the first strip additionally comprising at each end thereof at least one discrete eyelet;

each anchor comprising a flat rigid first portion for placement under the mat near an edge of the mat and a second portion extending generally upward beside that edge of the mat when the first portion is so placed, the second portion ending in a hook that may be passed through a discrete eyelet of the first strip to anchor in place the end of the first strip having that eyelet, the upward extension of the second portion of the anchor being less than the thickness of the mat so that the eyelets of the first strip are held below the upper surface of the mat when the strip is anchored in place, thereby to reduce the possibility of interference of the apparatus with the golfer's swing and the flight of the golf ball.

2. The apparatus of claim 1, wherein the anchors are removably attached to the ends of the strip.

3. The apparatus of claim 2, wherein the first strip has at each end thereof at least two discrete eyelets, whereby the strip may be anchored to the ground, if no golf practice mat is available, without removing the anchors from the ends of the strip by inserting a discrete tee through an eyelet at each end of the strip and into the ground.

4. An apparatus for temporary use with a golf driving range mat in teaching the proper stance for a golfer when swinging a golf club to hit a golf ball placed upon the mat or upon a tee inserted into a tee hole in the mat, the apparatus comprising, in combination:

a) a first strip of flat elastic material;

b) two first-strip anchors;

c) a second strip of flat elastic material; and d) two second-strip anchors;

the first strip having a length selected so that the strip will be under moderate tension when it is stretched across the mat from one edge of the mat to the opposite edge of the mat and held against the mat by a discrete one of the first-strip anchors at each end of the first strip, whereby the first strip may be stretched across the mat so that the first strip is aligned in parallel with the intended direction that the golf ball is to be hit and at a distance from the golf ball selected to be appropriate for the golfer, thereby providing a reference line for placement of the golfer's feet;

the second strip having a length selected so that the second strip will be under moderate tension when it is stretched across the mat from one edge of the mat to the opposite edge of the mat and held against the mat by a discrete one of the second-strip anchors at each end of the second strip, whereby the second strip may be stretched across the mat so that the second strip is perpendicular to the first strip and passes alongside the tee so that the head of the golf club will pass over the second strip after hitting the golf ball, thereby providing a second reference line for placement of the golfer's feet;

each said strip additionally comprising at each end thereof at least one discrete eyelet and each said anchor comprising a flat rigid first portion for placement under the mat near an edge of the mat and a second portion extending generally upward beside that edge of the mat when the first portion is so placed, the second portion ending in a hook that may be passed through a discrete eyelet of the associated strip to anchor in place the end of the strip having that associated eyelet, the upward extension of the second portion of the associated anchor being less than the thickness of the mat so that the eyelets of the strip are held below the upper surface of the mat when the strip is anchored in place, thereby to reduce the possibility of interference of the apparatus with the golfer's swing and the flight of the golf ball.

5. The apparatus of claim 4, wherein the anchors are removably attached to the ends of the strips.

6. The apparatus of claim 5, wherein each strip has at each end thereof at least two discrete eyelets, whereby the strips may be anchored to the ground, if no golf practice mat is available, without removing the anchors from the ends of the strips by inserting a discrete tee through an eyelet at each end of each strip and into the ground.

7. An apparatus for temporary use with a golf driving range mat in teaching the proper stance for a golfer when swinging a golf club to hit a golf ball placed upon the mat or upon a tee inserted into a tee hole in the mat, the apparatus comprising, in combination:

a) a first strip of flat elastic material;

b) two first-strip anchors;

c) a second strip of flat elastic material;

d) two second-strip anchors;

e) a third strip of flat elastic material; and f) two third-strip anchors;

the first strip having a length selected so that the strip will be under moderate tension when it is stretched across the mat from one edge of the mat to the opposite edge of the mat and held against the mat by a discrete one of the first-strip anchors at each end of the first strip, whereby the first strip may be stretched across the mat so that the first strip is aligned in parallel with the intended direction that the golf ball is to be hit and at a distance from the golf ball selected to be appropriate for the golfer, thereby providing a reference line for placement of the golfer's feet;

the second strip having a length selected so that the second strip will be under moderate tension when it is stretched across the mat from one edge of the mat to the opposite edge of the mat and held against the mat by a discrete one of the second-strip anchors at each end of the second strip, whereby the second strip may be stretched across the mat so that the second strip is perpendicular to the first strip and passes alongside the tee so that the head of the golf club will pass over the second strip after hitting the golf ball, thereby providing a second reference line for placement of the golfer's feet;

the third strip having a length selected so that the third strip will be under moderate tension when it is stretched across the mat over the second strip, generally parallel to the first strip and proximate the tee hole, and from one edge of the mat to the opposite edge of the mat and held against the mat by a discrete one of the third-strip anchors at each end of the third strip, thereby providing a reference line for the plane of the golfer's swing.

8. The apparatus of claim 7, wherein the anchors are removably attached to the ends of the strips.

9. The apparatus of claim 8, wherein each strip has at each end thereof at least two discrete eyelets, whereby the strips may be anchored to the ground, if no golf practice mat is available, without removing the anchors from the ends of the strips by inserting a discrete tee through an eyelet at each end of each strip and into the ground.

* * * * *